US006776146B1

(12) United States Patent
Ricart-Ugaz et al.

(10) Patent No.: US 6,776,146 B1
(45) Date of Patent: Aug. 17, 2004

(54) OBSTRUCTION OF FLOW TO IMPROVE FLOW MIX

(75) Inventors: Laura Ricart-Ugaz, Chicago, IL (US); Ivana Jojic, Redmond, WA (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/351,852

(22) Filed: Jan. 27, 2003

(51) Int. Cl.[7] ..... F02M 25/07
(52) U.S. Cl. ..... 123/568.17
(58) Field of Search ..... 123/568.11, 568.12, 123/568.15, 568.17, 568.18

(56) References Cited

U.S. PATENT DOCUMENTS 4,194,475 A * 3/1980 Saiki ..... 123/568.17
4,222,356 A * 9/1980 Ueda et al. ..... 123/568.18
4,364,369 A * 12/1982 Nomura et al. ..... 123/568.18
4,823,759 A * 4/1989 Mitani ..... 123/568.17
5,492,104 A * 2/1996 Elder et al. ..... 123/568.17
5,785,034 A * 7/1998 Moedinger et al. .... 123/568.18
5,975,064 A * 11/1999 Krimmer et al. ..... 123/568.18
6,293,265 B1 * 9/2001 Gagnon ..... 123/568.17
6,425,382 B1 * 7/2002 Marthaler et al. ..... 123/568.17
6,427,671 B1 * 8/2002 Holze et al. ..... 123/568.17
6,604,516 B1 * 8/2003 Krimmer et al. ..... 123/568.18

* cited by examiner

*Primary Examiner*—Willis R. Wolfe, Jr.
(74) *Attorney, Agent, or Firm*—Susan L. Lukasik; Dennis Kelly Sullivan; Jeffrey P. Calfa

(57) ABSTRACT

An apparatus for and method of obstructing an air intake flow (115) improves the mixing and driving force when an EGR flow (111) is introduced to the air intake flow (115). Before the EGR flow (111) enters a passage (113) where it is intended to be mixed with an air flow (115), the air flow (115) is obstructed to enable better and faster mixing of the EGR flow (111) with the air flow (115). A pressure differential is created to increase suction of EGR flow (111) into the intake air flow (115), thereby resulting in increased EGR flow (111) into the cylinders of an engine.

19 Claims, 4 Drawing Sheets

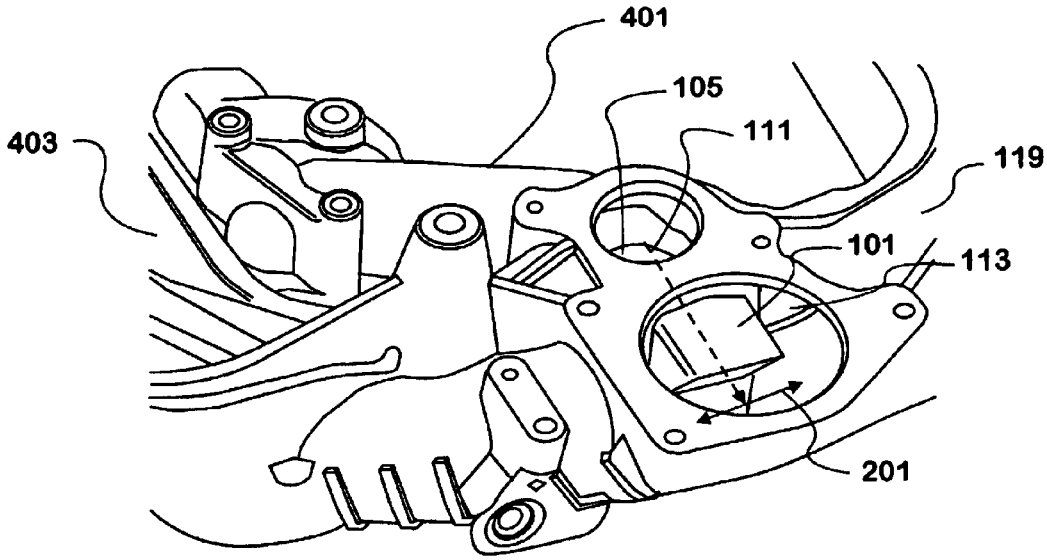
FIG. 4
FIG. 5
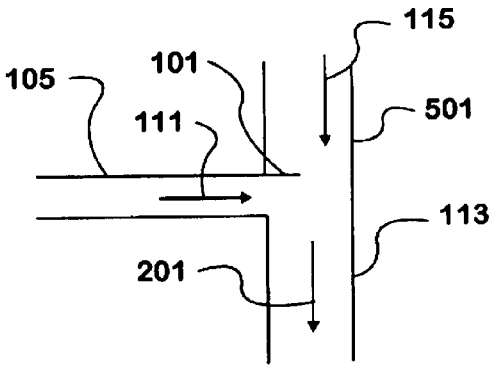
FIG. 6
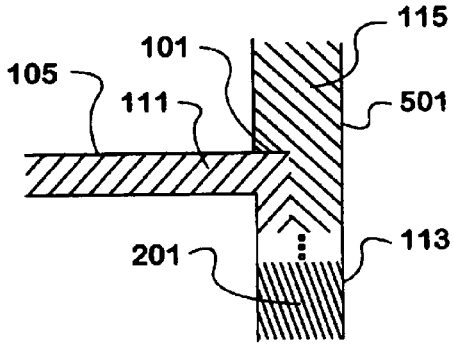

OBSTRUCTION OF FLOW TO IMPROVE FLOW MIX

FIELD OF THE INVENTION

This invention relates to air flow within internal combustion engines, including but not limited to mixing recirculated exhaust gas recirculation with intake air in internal combustion engines.

BACKGROUND OF THE INVENTION

Internal combustion engines are known to include exhaust gas recirculation (EGR) systems to reduce NOx (nitrous oxide) emissions. Air enters the engine through a turbocharger through a compressor, which pressurizes the air. The pressurized air flows to an intake manifold and enters the cylinders of the engine. The compressor is coupled to a turbine, which is driven by exhaust gas from the cylinders. The exhaust gas from the cylinders enters an exhaust manifold and flows into the turbine. The exhaust gas exits the turbine and is vented to the atmosphere. A fraction of the exhaust gas is diverted from entering the turbine and routed back to the intake manifold in a process known as exhaust gas recirculation (EGR). The resultant air charge to the cylinder contains both fresh air and combusted exhaust gas.

The EGR flow is driven from the exhaust manifold and is mixed with the air from the compressor to provide the air charge to the cylinders. The mixing process may need to take place in a short path, thus preventing a good mix of the EGR flow with the compressed air. Further, the EGR flow may be partially prevented from entering the passage with the compressed air because the compressed air flow is at the same or higher pressure than the EGR flow. As a result, the EGR flow may not successfully reach the cylinders as desired.

Accordingly, there is a need for a better way to mix EGR flow with air prior to introducing the mixture into the cylinders.

SUMMARY OF THE INVENTION

An apparatus for improving flow mix includes an EGR passage having an EGR flow moving through the EGR passage and into a mixing passage. An engine intake air passage has a first end and an engine intake air flow moving through the engine intake air passage and into the mixing passage. The exhaust gas recirculation passage, the mixing passage, and the engine intake air passage form a junction. An obstruction is positioned engine intake air flow such that a part of the engine intake air flow is disrupted while entering the mixing passage while permitting the EGR flow to enter the mixing passage and mix with the air flow.

BRIEF DESCRIPTION OF THE DRAWINGS

FIG. 4 is a top perspective view of an intake manifold with an obstruction to the air flow in accordance with the invention.

FIG. 5 is a diagram illustrating a cross-section view of flows at a junction with an obstruction to the air flow in accordance with the invention.

FIG. 6 is a diagram illustrating flow content at a junction with an obstruction to the air flow in accordance with the invention.

DESCRIPTION OF A PREFERRED EMBODIMENT

The following describes an apparatus for and method of obstructing a first flow, such as air intake flow, to improve the mixing and driving force when a second flow, such as an EGR flow, is introduced to the first flow. The outlet of an EGR passage is placed mid-stream of the air flow. The obstruction of the air flow enables better and faster mixing of the EGR flow with the air flow. A pressure differential is created to increase suction of EGR flow into the intake air flow, thereby resulting in increased EGR flow into the cylinders of an engine.

Figure 1:
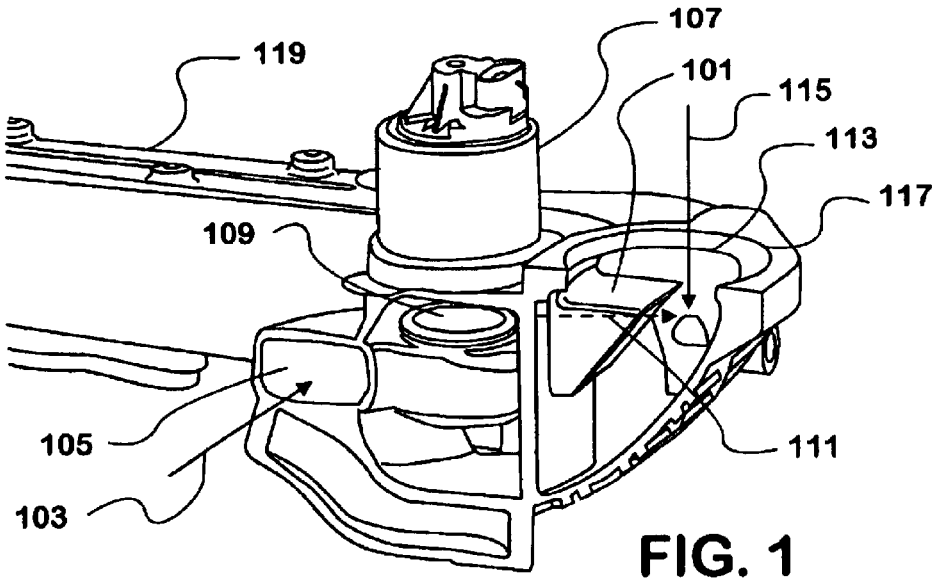
FIG. 1 is a cut-away perspective side view of an intake manifold with an EGR valve and an obstruction to the air flow in accordance with the invention.

A cut-away perspective side view of an intake manifold of an internal combustion engine with an EGR valve and an obstruction 101 to the air flow is shown in FIG. 1. The obstruction 101 is shown as a wedge having a rectangular surface with two tapering walls attached as sides. EGR flow 103 enters via an EGR inlet 105 and is regulated by an EGR valve 107. The EGR flow 103 passes through the EGR operator 109 and exits as regulated EGR flow 111 through an opening in the obstruction 101. The obstruction promotes the EGR flow 111. As shown in FIG. 1, the EGR flow 111 is substantially parallel to the rectangular surface of the obstruction 101. The EGR flow 111 enters a mixing passage 113 of an intake manifold of an internal combustion engine. An engine intake air flow 115, which may be compressed air when a turbocharger is utilized with the engine, enters an air inlet 117 from an air passage (not shown). A part of the air flow 115 is obstructed or hindered by the obstruction 101 prior to entering the mixing passage 113 on its way toward the cylinders along each side 119 of the intake manifold, thereby resulting in a low pressure region at the exit, i.e., downstream, of the obstruction 101. The obstruction 101 causes turbulence in the intake air flow 115.

Figure 2:
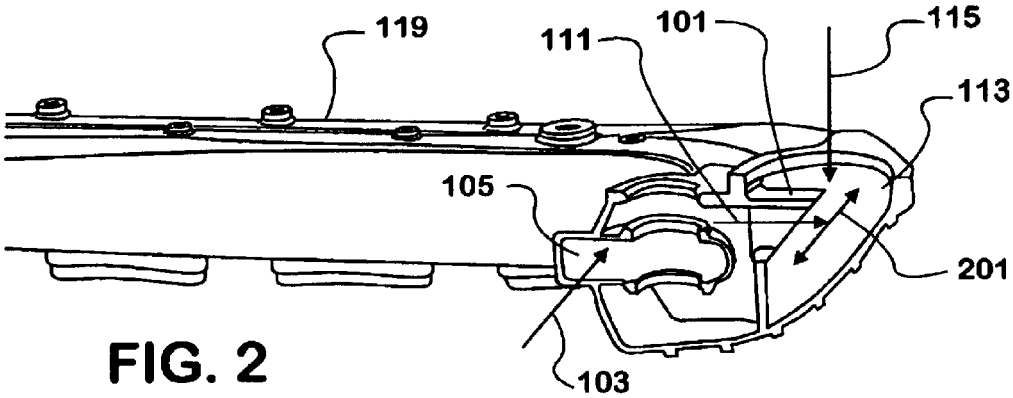
FIG. 2 is a cut-away perspective side view of an intake manifold with an obstruction to the air flow in accordance with the invention.

A cut-away perspective side view of an intake manifold with an obstruction 101 to the air flow is shown in FIG. 2. In this view, the obstruction 101 is show partially cut away to illustrate the flow 111 from the EGR valve 107 (not shown to illustrate the flow path) into the mixing passage 113. Once the EGR flow 111 and air flow 115 pass the obstruction 101, the flows mix into a flow 201 that includes both EGR flow 111 and air flow 115. As a result, the ability to drive the EGR flow 111 into the air flow 115, and thus into the intake manifold 113 and 119, is improved. The mixed flow 201 enters the cylinders of the engine.

Figure 3:
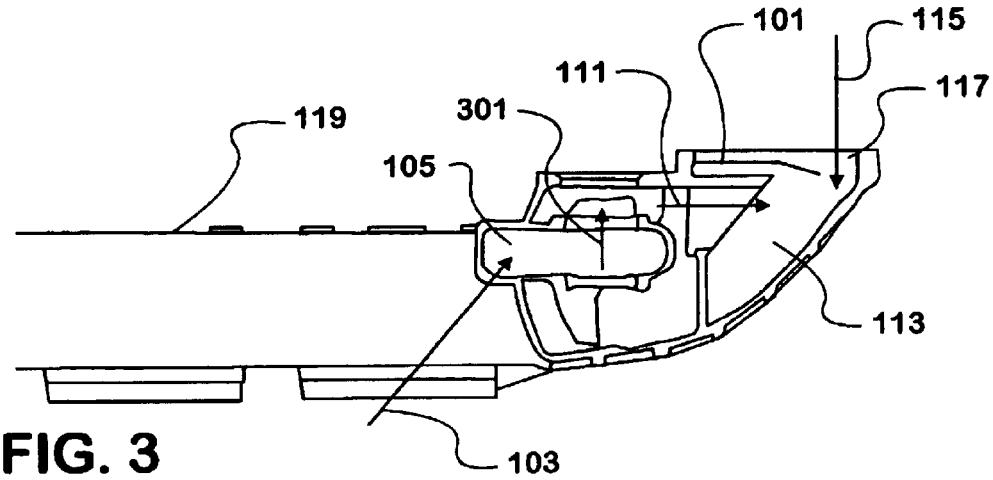
FIG. 3 is a cut-away side view of an intake manifold with an obstruction to the air flow in accordance with the invention.

A cut-away side view of an intake manifold with an obstruction to the air flow is shown in FIG. 3. This view illustrates the EGR flow 103 entering via an EGR inlet 105. The EGR flow 103 passes through the EGR valve 107 (not shown), through the obstruction 101, and into the mixing passage 113 of the intake manifold. The air flow 115 is shown substantially perpendicular to the EGR flow 111. The outlet of the EGR flow is placed mid-stream in the air flow. Velocities are higher mid-stream, and better mixing of the flows results.

A top perspective view of an intake manifold with an obstruction 101 to the air flow is shown in FIG. 4. EGR flow from the EGR system goes through an EGR passage 401 on its way to the EGR inlet 105. The EGR flow 111 passes through an opening in the obstruction 101 and enters the mixing passage 113, where it mixes with air to provide the flow 201 to the cylinders. In this example, the intake manifold is basically U-shaped, providing mixed air and exhaust 201 to one half of the cylinders of the engine via each of the legs 119 and 403 of the U. Other intake manifold shapes may be utilized while successfully practicing the present invention.

As shown in the figures, the EGR inlet 105, seating for the EGR valve 109, and obstruction 101 are integrated into the intake manifold, and more specifically, may be integrally cast into the intake manifold. The EGR inlet 105, seating for the EGR valve 109, and/or obstruction 101 may be integrated into the intake manifold, or may be separate from the intake manifold, or a combination thereof.

A diagram illustrating flows at a junction with an obstruction to the air flow is shown in FIG. 5. The diagram illustrates the flow direction and mixing of the EGR flow 111 and air flow 115 into a mixed flow 201 that flows through one or more mixing passages 113 of the intake manifold. In this example, the mixing passage 113 in which the flows 111 and 115 merge is shown parallel to the air flow passage 501.

A diagram illustrating content of flows at a junction with an obstruction to the air flow is shown in FIG. 6. The diagram illustrates EGR flow 111 in the EGR inlet 105 and in the mixing passage 113 near the obstruction 101. Air flow 115 is present in the air passage 501 and downstream of the obstruction 101. Further downstream, the EGR flow 111 and air flow 115 combine, forming a mixed flow 201 that is provided to the cylinders.

Figure 7:
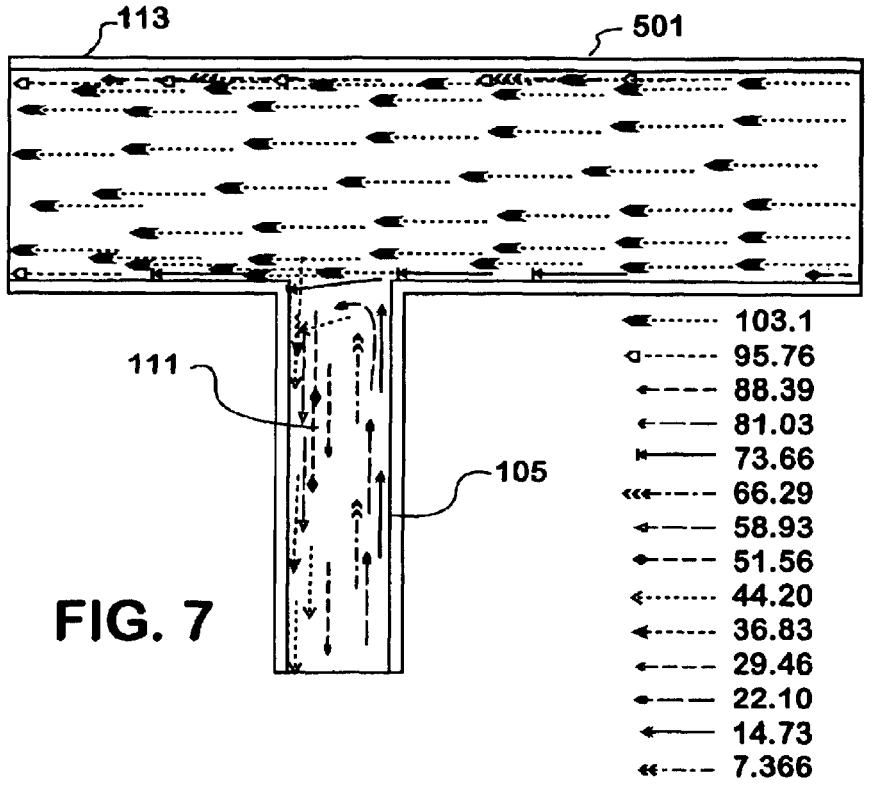
FIG. 7 is a diagram illustrating velocity of flows at a junction without an obstruction to the air flow.

A diagram illustrating velocity of flows at a junction without an obstruction to the air flow is shown in FIG. 7. This diagram shows when the air flow and the EGR flow are at the same pressure, no EGR flow results past the junction.

Figure 8:
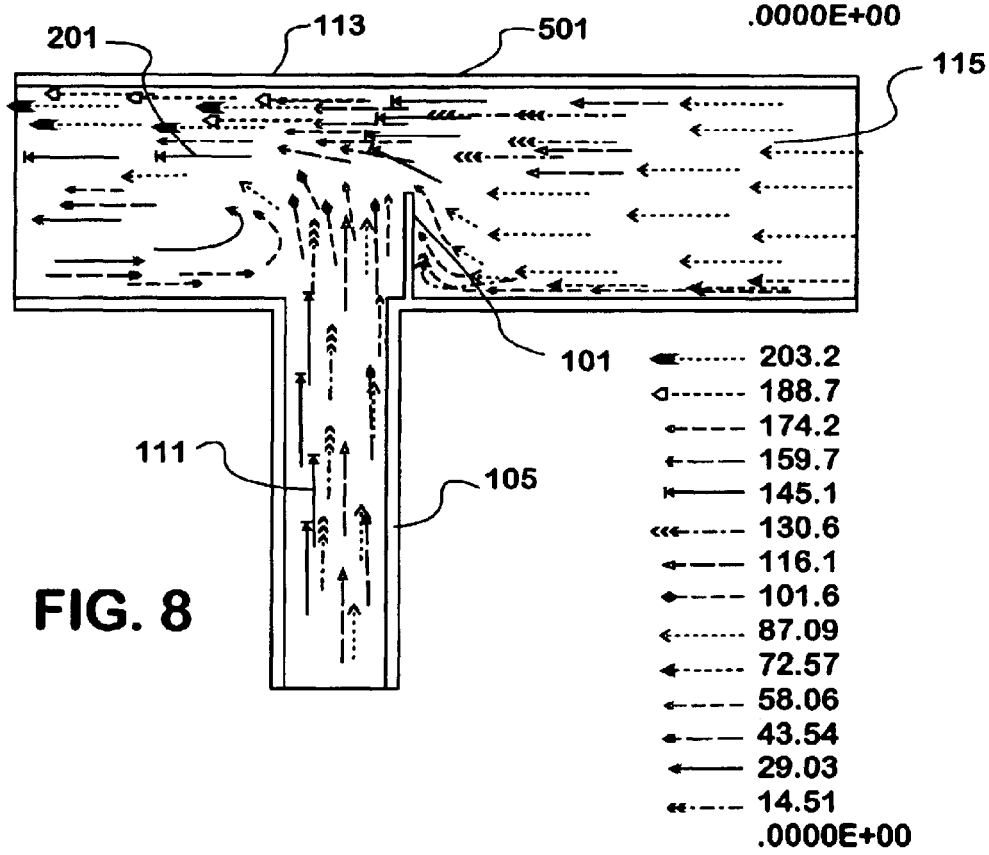
FIG. 8 is a diagram illustrating velocity of flows at a junction with an obstruction to the air flow in accordance with the invention.

A diagram illustrating velocity of flows at a junction with an obstruction to the air flow is shown in FIG. 8. This diagram shows how the air flow 115 going past the obstruction 101 results in a low pressure region at the exit of the passage 105 (see FIG. 9), facilitates the EGR flow 111 to enter the mixing passage 113, and mix more efficiently with the air flow 115, resulting in a mixed flow 201 that has a higher percentage of EGR flow 111 than the EGR flow 111 of the example shown in FIG. 7. Furthermore, the flow structures created by the obstruction 101 are better able to mix the air flow 115 and the EGR flow 111. Higher EGR flow results in lower emissions levels from the engine.

Figure 9:
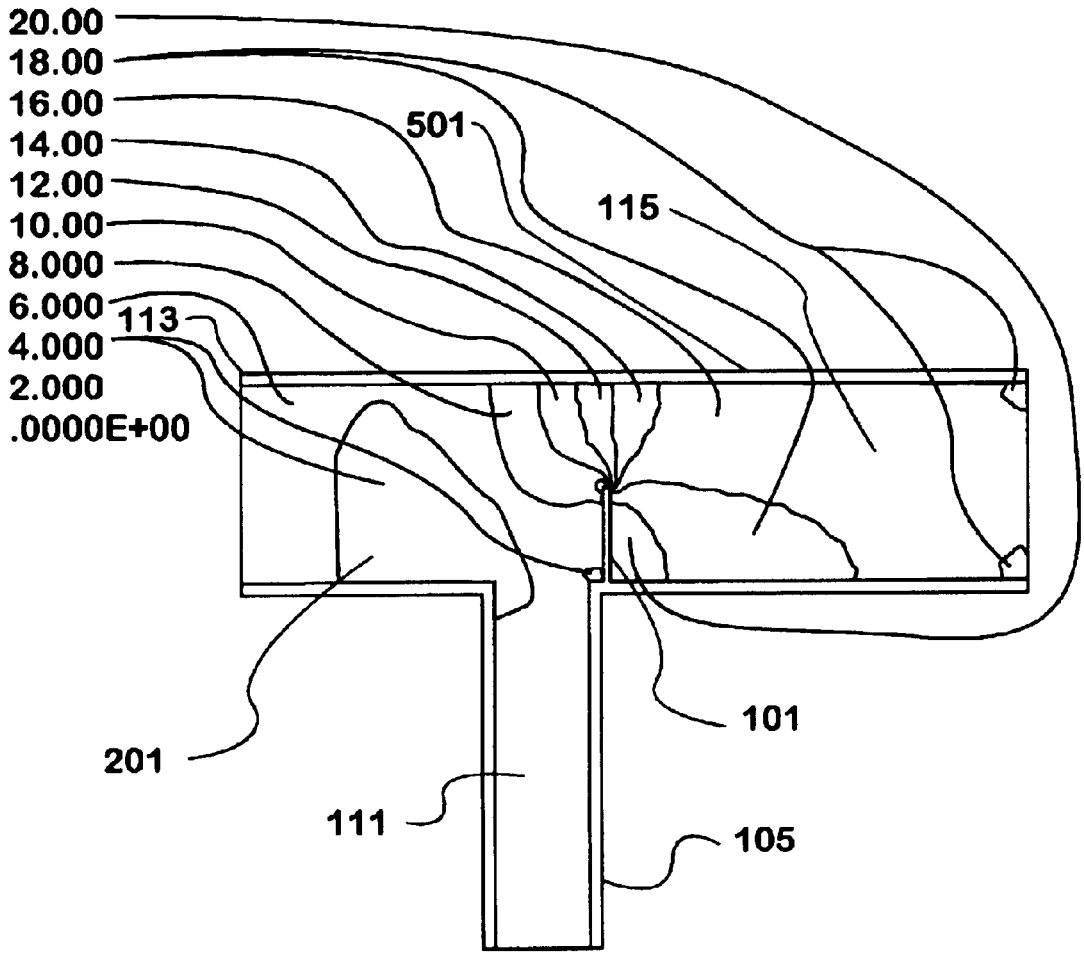
FIG. 9 is a diagram illustrating pressure of flows at a junction with an obstruction to the air flow in accordance with the invention.

A diagram illustrating pressure of flows at a junction with an obstruction to the air flow is shown in FIG. 9. As expected, the highest pressure is found upstream of the obstruction 101, with respect to the air flow 115, and the lowest pressure is downstream, with respect to the air flow 115, of the EGR inlet 105 or behind the obstruction 101. Suction power is proportional to the pressure difference between two streams. Lowering the pressure locally by utilizing an obstruction 101 increases the pressure difference between the EGR flow 111 and the air flow 115, thereby driving the EGR flow 111 into the mixing passage 113.

FIG. 1 through FIG. 4 show the obstruction 101 as a wedge-shaped device having a wall that extends approximately halfway across the passage for the air flow 115 and has two substantially parallel sides that taper away from the wall and provide a path, along with the wall, for the EGR flow 111 to enter the mixing passage 113 and mix with the air flow 115. Other shapes for the obstruction 101 will also be successful. For example, the general shape of the obstruction 101 may be round with a tapered cut at the end, such that the longer end of the obstruction 101 is upstream, with respect to the air flow 115, of the shorter end of the obstruction 101. In general, whatever its shape, the obstruction 101 functions in an opposite way as a Pitot tube, i.e., as a reverse Pitot tube, such that the obstruction 101 disturbs air flow 115 while facilitating EGR flow 111 to mix into the air flow 115.

Although the EGR flow 111 is shown substantially parallel to the opening provided by the obstruction 101, the air flow 115 is shown substantially perpendicular to EGR flow 111, and the mixing passage 113 is shown substantially perpendicular to the EGR flow 111 and the air flow 115, other orientations between the flows, passages, and the obstruction will make successful use of the present invention.

By placing an obstacle or obstruction in the air flow, suction between the EGR flow and the air flow is improved. Lower pressure at the EGR mixing point provides a more-efficient way to drive EGR into the air intake flow. Increased EGR flow and improved mixing of the streams from an EGR passage and an engine intake air passage also result. Because more EGR flow reaches the cylinders, emissions levels for the engine are reduced.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An apparatus for use in an internal combustion engine, the apparatus comprising:

an exhaust gas recirculation passage having an exhaust gas recirculation flow moving through the exhaust gas recirculation passage and flowing into a mixing passage;

an engine intake air passage having a first end and an engine intake air flow moving through the engine intake air passage and into the mixing passage, wherein the exhaust gas recirculation passage, the mixing passage, and the first end of the engine intake air passage form a junction;

an obstruction positioned in the engine intake air passage and near the first end of the engine intake air passage such that the engine intake air flow is partially obstructed while entering the mixing passage while permitting the exhaust gas recirculation flow to enter the mixing passage and mix with the engine intake air flow, wherein the obstruction comprises a generally flat surface positioned generally perpendicular to the engine intake air flow.

2. The apparatus of claim 1, wherein the obstruction is positioned parallel to the exhaust gas recirculation flow and perpendicular to the engine intake air flow.

3. The apparatus of claim 1, wherein the obstruction is a reverse Pitot tube.

4. The apparatus of claim 1, wherein the obstruction has a first surface and a second surface that is opposite to the first surface, wherein the second surface is downstream of the first surface with respect to the engine intake air flow, and wherein the first surface extends further away from the exhaust gas recirculation passage than the second surface extends from the exhaust gas recirculation passage.

5. The apparatus of claim 1, wherein the obstruction comprises a first wall, a second wall, and a third wall; wherein the first wall obstructs the engine intake air flow; wherein the first wall forms a first corner with the second wall and a second corner with the third wall; wherein the second wall is substantially parallel to the third wall; wherein the second wall and the third wall taper from a distal end of the first wall toward the exhaust gas recirculation passage; and wherein the exhaust gas recirculation flow passes between the first wall, the second wall, and the third wall.

6. The apparatus of claim 1, wherein the exhaust gas recirculation passage is perpendicular to the mixing passage, and wherein the engine intake air passage is perpendicular to the exhaust gas recirculation passage and the mixing passage.

7. The apparatus of claim 1, wherein the exhaust gas recirculation passage, the engine intake air passage, at least a part of the mixing passage, and the obstruction are integrated in an intake manifold.

8. A method comprising the steps of:

receiving, in a combined passage, exhaust gas recirculation flow from an exhaust gas recirculation passage;

receiving, in the combining passage, a first part of an engine intake air flow from a mixing passage;

obstructing, with a generally flat surface of the exhaust gas recirculation passage, a second part of the engine intake air flow while entering the combining passage such that the exhaust gas recirculation flow and the second part of the engine intake air flow are mixed in the combining passage.

9. The method of claim 8, wherein the step of obstructing comprises the step of creating a pressure differential to increase suction of exhaust gas recirculation flow into the engine intake air flow.

10. The method of claim 8, wherein the step of obstructing comprises positioning an obstruction parallel to the exhaust gas recirculation flow and perpendicular to the engine intake air flow.

11. The method of claim 8, wherein the step of obstructing comprises positioning a reverse Pltot tube to obstruct the second part of the engine intake air flow.

12. The method of claim 8, wherein the step of obstructing comprises positioning an obstruction parallel to the exhaust gas recirculation flow and perpendicular to the engine intake air flow, wherein the obstruction has a first surface and a second surface that is opposite to the first surface, wherein the second surface is downstream of the first surface with respect to the engine intake air flow, and wherein the first surface extends further away from the exhaust gas recirculation passage than the second surface extends from the exhaust gas recirculation passage.

13. The method of claim 8, wherein the step of obstructing comprises positioning an obstruction parallel to the exhaust gas recirculation flow and perpendicular to the engine intake air flow, wherein the obstruction comprises a first wall, a second wall, and a third wall; wherein the first wall obstructs the engine intake air flow; wherein the first wall forms a first corner with the second wall and a second corner with the third wall; wherein the second wall is substantially parallel to the third wall; wherein the second wall and the third wall taper from a distal end of the first wall toward the exhaust gas recirculation passage; and wherein the exhaust gas recirculation flow passes between the first wall, the second wall, and the third wall.

14. An apparatus comprising:

an exhaust gas recirculation passage having an exhaust gas recirculation (EGR) flow moving through the exhaust gas recirculation passage and into a mixing passage;

an engine intake air passage having a first end and an engine intake air flow moving through the engine intake air passage and into the mixing passage, wherein the exhaust gas recirculation passage, the mixing passage, and the engine intake air passage form a junction;

a generally flat surface of an obstruction positioned generally perpendicular to the engine intake air flow such that a part of the engine intake air flow is disrupted while entering the mixing passage while permitting the EGR flow to enter the mixing passage and mix with the air flow.

15. The apparatus of claim 14, wherein the obstruction has a first surface and a second surface that is opposite to the first surface, wherein the second surface is downstream of the first surface with respect to the air flow, and wherein the first surface extends further away from the exhaust gas recirculation passage than the second surface extends from the exhaust gas recirculation passage.

16. The apparatus of claim 14, wherein the exhaust gas recirculation passage is perpendicular to the mixing passage, and wherein the engine intake air passage is perpendicular to the exhaust gas recirculation passage and the mixing passage.

17. The apparatus of claim 14, wherein the obstruction is positioned to increase EGR flow.

18. The apparatus of claim 14, wherein the obstruction creates a pressure differential to increase suction of exhaust gas recirculation flow into the engine intake air flow.

19. The apparatus of claim 14, wherein the exhaust gas recirculation passage, the engine intake air passage, at least a part of the mixing passage, and the obstruction are integrally cast in an intake manifold.

* * * * *